US009643291B2

(12) United States Patent
Hagiwara

(10) Patent No.: US 9,643,291 B2
(45) Date of Patent: May 9, 2017

(54) POLISHING METHOD

(71) Applicant: OLYMPUS CORPORATION, Shibuya-ku, Tokyo (JP)

(72) Inventor: Genichiro Hagiwara, Hino (JP)

(73) Assignee: OLYMPUS CORPORATION, Tokyo (JP)

( * ) Notice: Subject to any disclaimer, the term of this patent is extended or adjusted under 35 U.S.C. 154(b) by 0 days.

(21) Appl. No.: 15/066,896

(22) Filed: Mar. 10, 2016

(65) Prior Publication Data

US 2016/0193710 A1 Jul. 7, 2016

Related U.S. Application Data

(63) Continuation of application No. PCT/JP2014/076290, filed on Oct. 1, 2014.

(30) Foreign Application Priority Data

Nov. 11, 2013 (JP) ..... 2013-233486

(51) Int. Cl.
*B24B 1/00* (2006.01)
*B24B 13/02* (2006.01)

(52) U.S. Cl.
CPC ..... *B24B 1/00* (2013.01); *B24B 13/02* (2013.01)

(58) Field of Classification Search
CPC ..... B24B 1/00; B24B 13/02; B24B 37/042; B24B 37/04; B24B 13/005; B24B 13/00;
(Continued)

(56) References Cited

U.S. PATENT DOCUMENTS 2,607,174 A 8/1952 Lanius
4,598,502 A * 7/1986 Lombard ..... B24B 13/02 451/277
(Continued)

FOREIGN PATENT DOCUMENTS

JP 5110464 Y1 3/1976
JP 63120071 A 5/1988
(Continued)

OTHER PUBLICATIONS

International Search Report (ISR) dated Nov. 25, 2014 issued in International Application No. PCT/JP2014/076290.

*Primary Examiner* — Dung Van Nguyen
(74) *Attorney, Agent, or Firm* — Holtz, Holtz & Volek PC

(57) ABSTRACT

A polishing method comprising: arranging a polishing tool and a workpiece on lower and upper shaft sides of a polishing device, respectively, the polishing tool including: a polishing surface having a spherical zone shape; and a hole that is provided inside the polishing surface and concentric with an outer edge of the polishing surface around a rotation axis on a projection plane orthogonal to the rotation axis, a ratio of an outer diameter of the polishing surface to an inner diameter of the polishing surface being greater than 1.0 and 6.0 or less; and swinging the polishing tool relative to a reference point while rotating the polishing tool around the rotation axis. The reference point is positioned where a straight line, which passes through a center of the workpiece and intersects with the rotation axis, passes through a center of a spherical zone of the polishing surface in width direction.

1 Claim, 8 Drawing Sheets

(58) Field of Classification Search
CPC B24B 9/14; B24B 9/148; B24B 9/065; B24B 9/10; B24B 7/228; H01L 21/02021
See application file for complete search history.

(56) References Cited

U.S. PATENT DOCUMENTS

| | | | | | |
|---|---|---|---|---|---|
| 4,928,435 | A * | 5/1990 | Masaki | B24B 13/00 | 451/159 |
| 5,951,375 | A * | 9/1999 | Mandler | B24B 13/005 | 451/384 |
| 6,932,678 | B2 * | 8/2005 | Toyoshima | B24B 13/005 | 451/277 |
| 2012/0289127 | A1 * | 11/2012 | Kojima | B24B 13/02 | 451/42 |
| 2015/0024663 | A1 * | 1/2015 | Torikai | B24B 13/005 | 451/42 |

FOREIGN PATENT DOCUMENTS

| | | | |
|---|---|---|---|
| JP | 09300191 | A | 11/1997 |
| JP | 2006136959 | A | 6/2006 |
| JP | 2013226620 | A | 11/2013 |

* cited by examiner

POLISHING METHOD

CROSS-REFERENCE TO RELATED APPLICATIONS

This application is a continuation of PCT international application Ser. No. PCT/JP2014/076290 filed on Oct. 1, 2014 which designates the United States, incorporated herein by reference, and which claims the benefit of priority from Japanese Patent Application No. 2013-233486, filed on Nov. 11, 2013, incorporated herein by reference.

BACKGROUND

1. Technical Field

The disclosure relates to a polishing method for finishing a surface of an optical element such as a lens.

2. Related Art

Generally, in order to finish a surface of an optical element such as a lens, a prism, and a mirror, polishing is performed by sliding a polishing tool and a workpiece against each other. Specifically, a polishing sheet made of polyurethane adheres to such a polishing tool, and abrasive grains for polishing, interposed at an interface between the polishing tool and the workpiece, are used for polishing.

In recent years, there has been a demand for an optical element with high shape accuracy which is free from surface distortion. Accordingly, a polishing device for improving finishing accuracy of a workpiece has been proposed. Specifically, such a polishing device includes means that rotates a polishing tool, means that rotates the workpiece, and swing means that swings a relative positional relation between the polishing tool and the workpiece (for example, refer to Japanese Laid-open Patent Publication No. 09-300191).

In addition, a polishing tool to polish a workpiece has also been proposed, in which a distance from a rotation axis of the polishing tool to an outer peripheral shape of a work surface that polishes the workpiece is not constant in a rotation direction (for example, refer to Japanese Laid-open Patent Publication No. 2006-136959).

SUMMARY

In some embodiments, a method for polishing a workpiece executed by a polishing device having a polishing tool is presented. The method includes the steps of: arranging the polishing tool on a lower shaft side of the polishing device, the polishing tool including: a polishing surface having a predetermined radius of curvature; and hole that is provided inside the polishing surface and is concentric with an outer edge of the polishing surface around a rotation axis on a projection plane orthogonal to the rotation axis, wherein the polishing surface has a spherical zone shape, and a ratio of an outer diameter of the polishing surface to an inner diameter of the polishing surface is greater than 1.0 and equal to or less than 6.0, and a ratio of a spherical zone width of the polishing surface to an outer diameter of the workpiece is equal to or greater than 0.9; arranging only the workpiece on an upper shaft side of the polishing device; and swinging the polishing tool at a constant swing width with respect to a reference point while rotating the polishing tool around the rotation axis to polish the workpiece, wherein the reference point is provided at a position where a straight line, which passes through a center of the workpiece and intersects with the rotation axis, passes through a center of a spherical zone of the polishing surface in a width direction.

The above and other features, advantages and technical and industrial significance of this invention will be better understood by reading the following detailed description of presently preferred embodiments of the invention, when considered in connection with the accompanying drawings.

DETAILED DESCRIPTION

Figure 1:
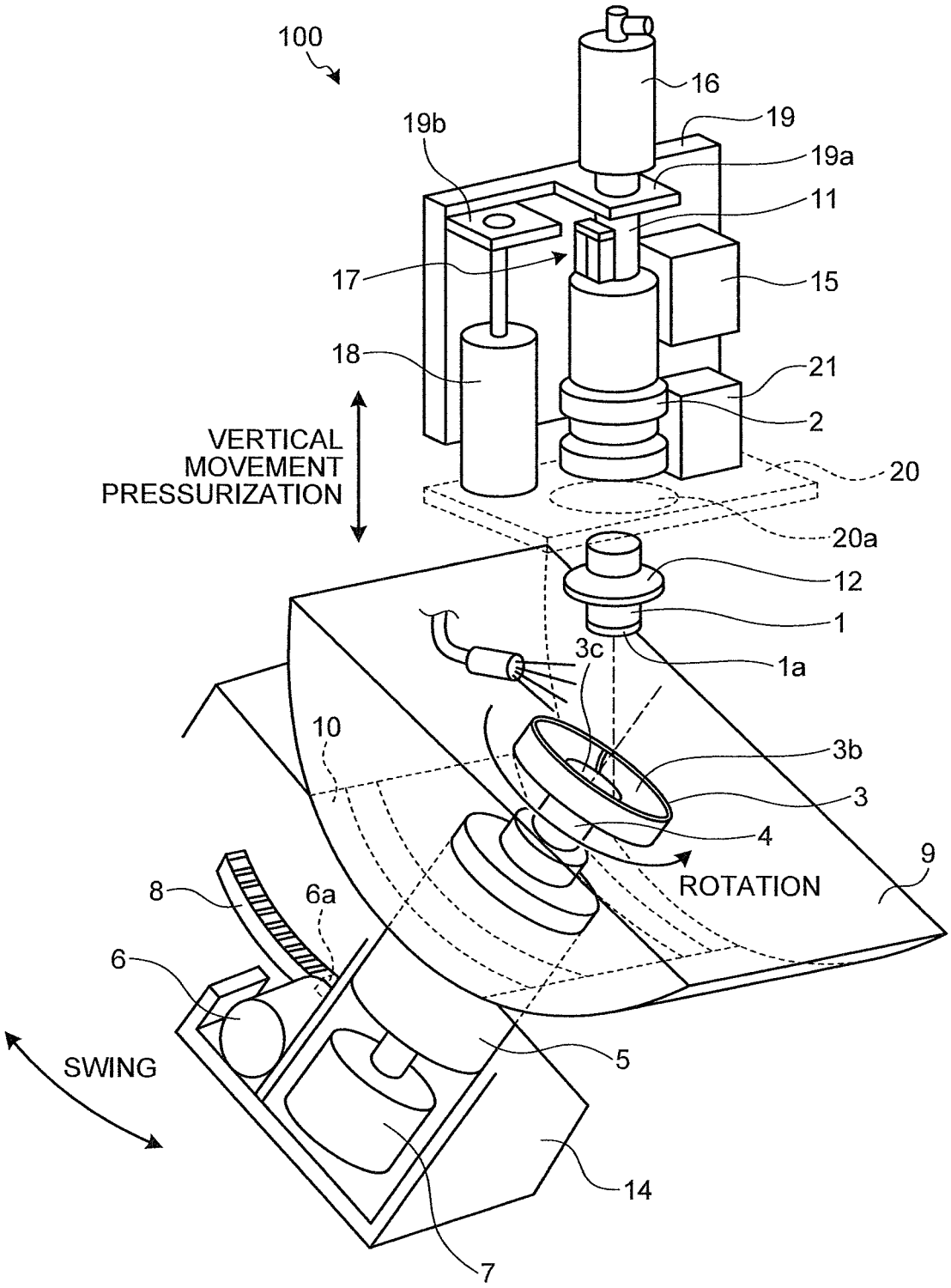
FIG. 1 is a schematic view illustrating a configuration of a polishing device according to an embodiment of the present invention.

Hereinafter, embodiments of the present invention will be described referring to the drawings. The present invention is not limited by the embodiments. The same reference signs are used to designate the same elements throughout the drawings. Note that the drawings are only schematic, and dimensional relations and ratios between the elements are different from actual ones. Dimensional relations and ratios between the elements in the different drawings may also be different from one another.

Embodiments

Figure 2:
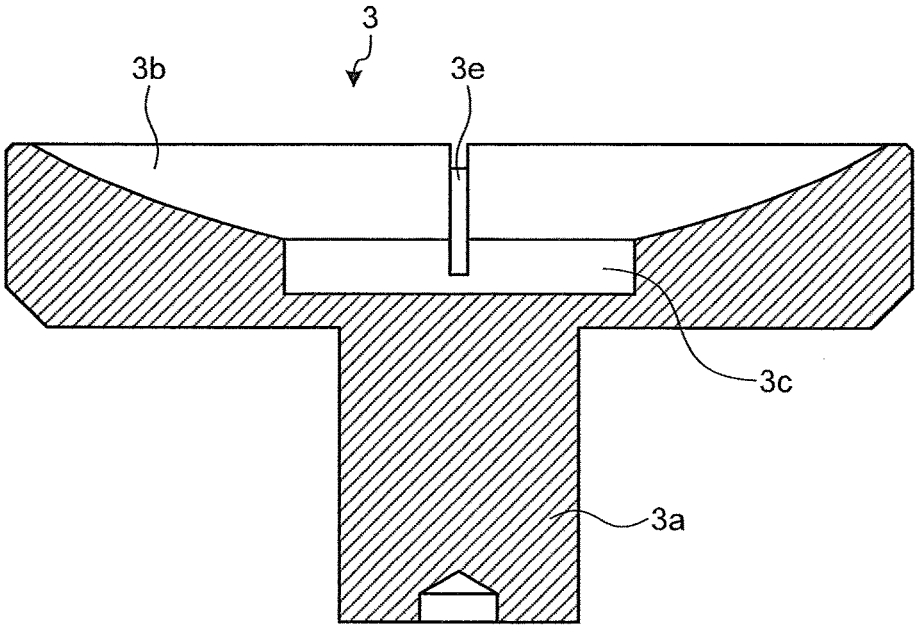
FIG. 2 is a cross-sectional view illustrating a polishing tool used in FIG. 1.
Figure 3:
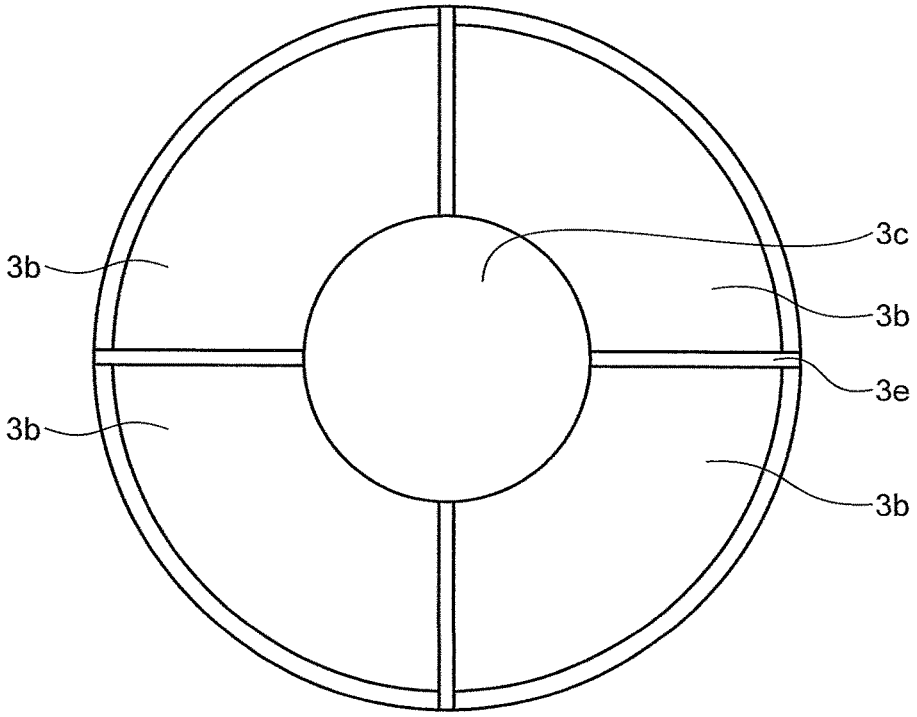
FIG. 3 is a top view illustrating the polishing tool of FIG. 2.

FIG. 1 is a schematic view illustrating a configuration of a polishing device according to an embodiment of the present invention. FIG. 2 is a cross-sectional view illustrating a polishing tool used in FIG. 1. FIG. 3 is a top view illustrating the polishing tool of FIG. 2.

A polishing device 100 according to the embodiment includes a polishing tool 3, a holder 2, a rotation motor 7, and a swing motor 6. The holder 2 allows a lens 1 as a workpiece to abut on a polishing surface 3*b* of the polishing tool 3. The rotation motor 7 rotates the polishing tool 3. The swing motor 6 swings the polishing tool 3.

As illustrated in FIGS. 2 and 3, the polishing tool 3 includes a base plate 3*a*, the polishing surface 3*b*, and a hole 3*c*. The polishing surface 3*b* has a predetermined radius of curvature. The hole 3*c* is provided inside the polishing surface 3*b* and is concentric with an outer edge of the polishing surface 3*b* around a rotation axis of the polishing tool 3 on a projection plane orthogonal to the rotation axis. The base plate 3*a* is formed to have a predetermined radius of curvature obtained by substantially inverting a shape of the workpiece, namely the lens 1. A viscoelastic sheet made of, for example, polyurethane is stuck to a surface of the base plate 3*a*, whereby the polishing surface 3*b* having the predetermined radius of curvature is formed. In FIGS. 2 and 3, four viscoelastic sheets are stuck to form four polishing surfaces 3*b*. The number of viscoelastic sheets, however, is not limited to this example. In the embodiment, the polishing surface 3*b* has a spherical zone shape. Specifically, the top of the spherical surface of the polishing surface 3*b* is cut off by a plane crossing an opening of the hole 3*c*, and the spherical surface of the polishing surface 3*b* is further cut off by another plane parallel to the aforementioned plane, whereby the spherical zone shape is formed. A groove 3*e* is formed between the viscoelastic sheets. A polishing agent is spread over the entire polishing surface 3*b* through the groove 3*e*, and sludge generated by polishing is discharged from the groove 3*e*.

As illustrated in FIG. 1, the polishing tool 3 is connected to an upper end of a tool shaft 4, and the tool shaft 4 is integrated with a spindle 5. The spindle 5 is connected to the rotation motor 7. The rotation motor 7 is fixed to a lower shaft base 14 that rotatably supports the spindle 5. The rotation motor 7 (rotation unit) is controlled by a control device which is not illustrated in the drawing, and rotates the polishing tool 3 around a center of the rotation axis. An upper part of the lower shaft base 14 penetrates a swing member 9, whereby an upper outer peripheral surface of the lower shaft base 14 is integrally attached to the swing member 9. The swing motor 6 is fixed to the lower shaft base 14 such that a rotation axis of the swing motor 6 is orthogonal to the rotation axis of the rotation motor 7. The swing motor 6 swings the swing member 9 under the control of a control device which is not illustrated in the drawing. A rotation speed and the number of rotations of the swing motor 6 can be arbitrarily controlled. The swing motor 6 and the swing member 9 constitute a swing unit.

The swing member 9 is has a boat shape, a lower surface of which is supported by a swing member receiving part 10 fixed to a main body of the polishing device 100. A surface of the swing member receiving part 10 facing the swing member 9 has a concave curved shape corresponding to a bottom surface of the swing member 9, which has the boat shape. The swing member receiving part 10 thus swingably supports the swing member 9, and also forms an opening part (not illustrated) for preventing the swing member 9 during swinging from interfering with the lower shaft base 14.

A gear 6*a* is attached to a drive shaft of the swing motor 6, and engaged with a guide 8 having an arc shape. The guide 8 is fixed to a polishing device main body 20. The swing motor 6 allows the gear 6*a* to move rotationally along the guide 8, thereby swinging the lower shaft base 14. The swing member 9 and the polishing tool 3 or the like are thus configured to swing back and forth.

The lens 1 is stuck to and held by a sticking plate 12, and arranged above the polishing tool 3. The lens 1 is supported rotatably relative to the holder 2 in such a way that a lens processing surface (spherical surface of the lens) la having a convex spherical shape faces the polishing tool 3, and the sticking plate 12 is held within the holder 2 serving as a holding tool. Although the sticking plate 12 and the holder 2 are illustrated separately in FIG. 1, they are to be assembled via the polishing device main body 20. The holder 2 is connected to a lower end side of a work shaft 11. The work shaft 11 is moved up and down by a rod of a pressurizing air cylinder 16 joined to an upper end of the work shaft 11.

The pressurizing air cylinder 16 is attached to a first attaching plate 19*a* fixed to an upper surface of a back plate 19. The lens 1 is lowered to the polishing tool 3 under the control of a control device which is not illustrated in the drawing. When processing such a lowered lens 1, the pressurizing air cylinder 16 allows the lens processing surface 1*a* to abut on the polishing surface 3*b* of the polishing tool 3, and pressurizes the lens processing surface 1*a*. The first attaching plate 19*a* and the back plate 19 are not moved up and down during the processing for the lens 1.

A central axis line of the work shaft 11 is positioned on an axis line passing through a curvature center at the polishing surface 3*b* of the polishing tool 3. A coarse movement air cylinder 18, a rod of which is joined to a second attaching plate 19*b* fixed to a front surface of the back plate 19, is configured to move the back plate 19 and the pressurizing air cylinder 16 or the like up and down. The coarse movement air cylinder 18 is fixed to the polishing device main body 20, and arranged such that the work shaft 11 and the holder 2 pass through a hole 20*a* drilled in the polishing device main body 20 (note that they do not pass through the hole 20*a* in FIG. 1 for illustration), thereby allowing the lens 1 to face the polishing tool 3. The above-mentioned pressurizing air cylinder 16 pressurizes, in a downward moving direction (downward in a vertical direction), the holder 2 or the like that supports the lens 1.

At the back plate 19 and the work shaft 11 below the pressurizing air cylinder 16, a linear scale 17 (position detector) is arranged which serves as a measurement device whose movable and fixed sides are paired. The linear scale 17 is configured to detect a moving amount of the work shaft 11 by the pressurizing air cylinder 16. The moving amount is displayed on an indicator (not illustrated). A stopper 15 whose position is adjustable up and down is fixed to the back plate 19. The stopper 15 on a side of the back plate 19 is configured to come into contact with a stopper (main body side) 21 fixed to the polishing device main body 20 when the back plate 19, namely an entire upper part including the holder 2 that supports the lens 1 via the back plate 19, is lowered by the coarse movement air cylinder 18.

Figure 4:
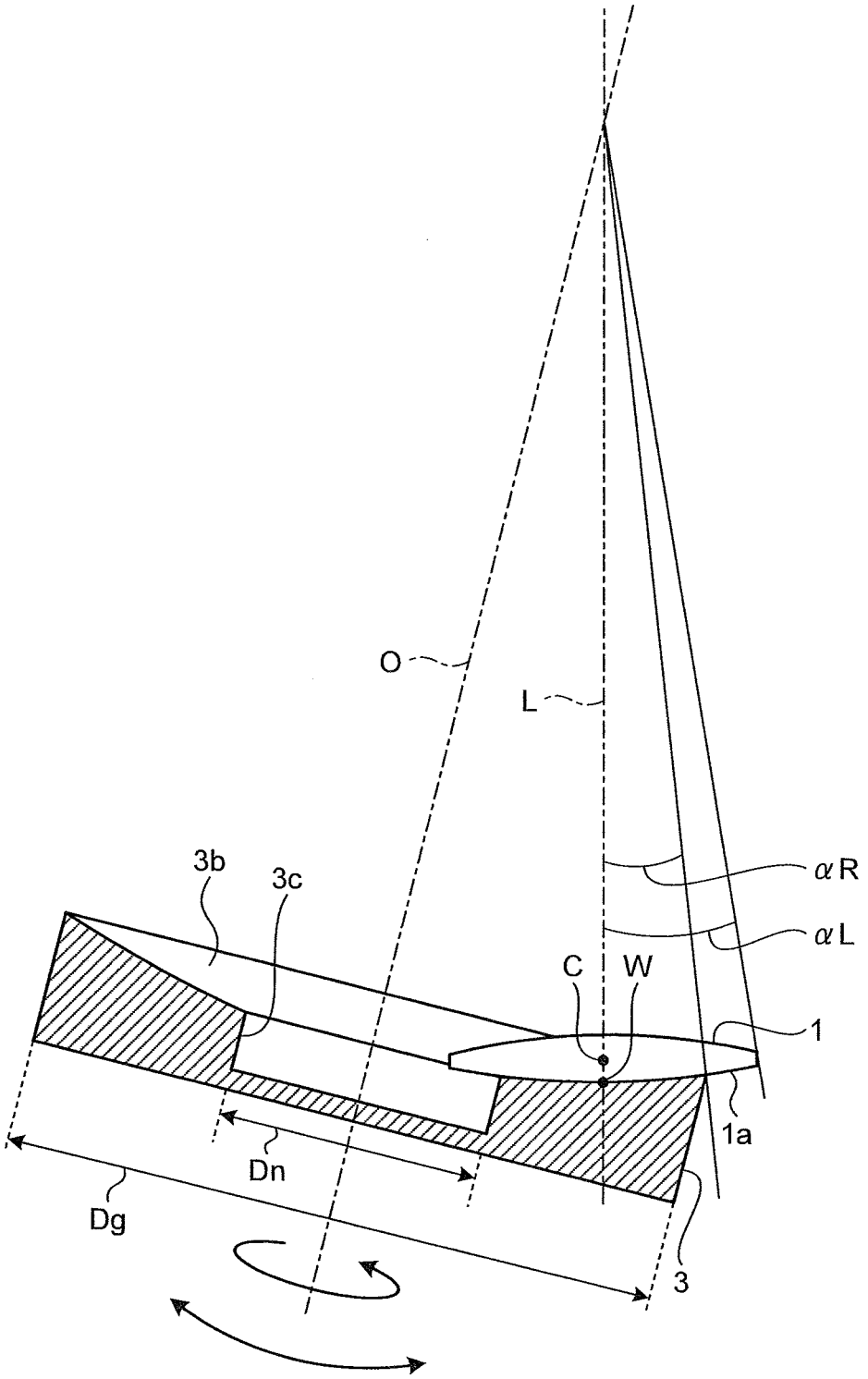
FIG. 4 is a schematic view (cross-sectional view) describing polishing for a lens in the polishing device of FIG. 1.
Figure 5:
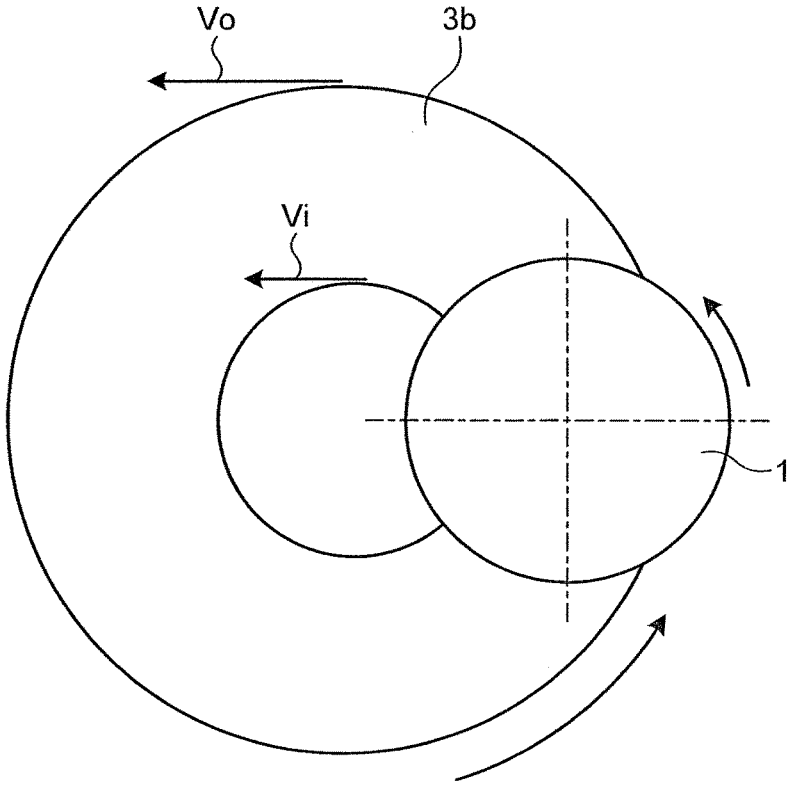
FIG. 5 is a schematic view (top view) describing the polishing for the lens in the polishing device of FIG. 1.
Figure 6:
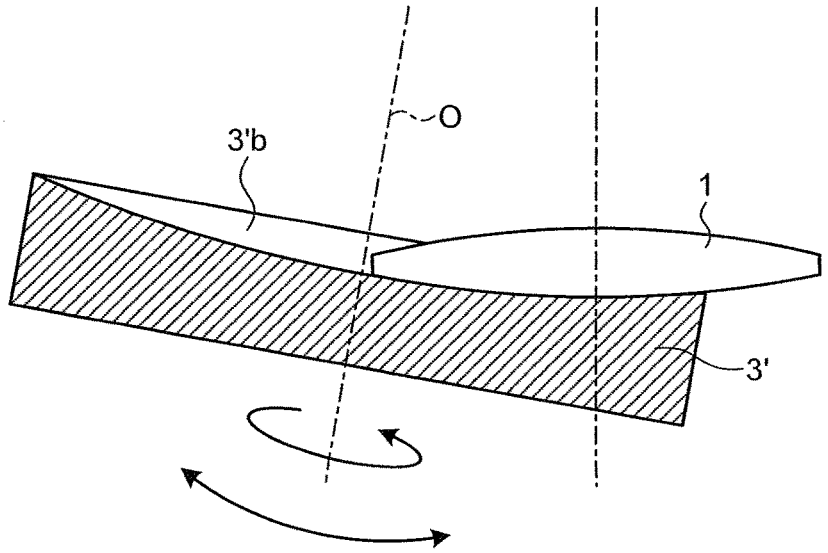
FIG. 6 is a schematic view (cross-sectional view) describing polishing by a conventional polishing tool.
Figure 7:
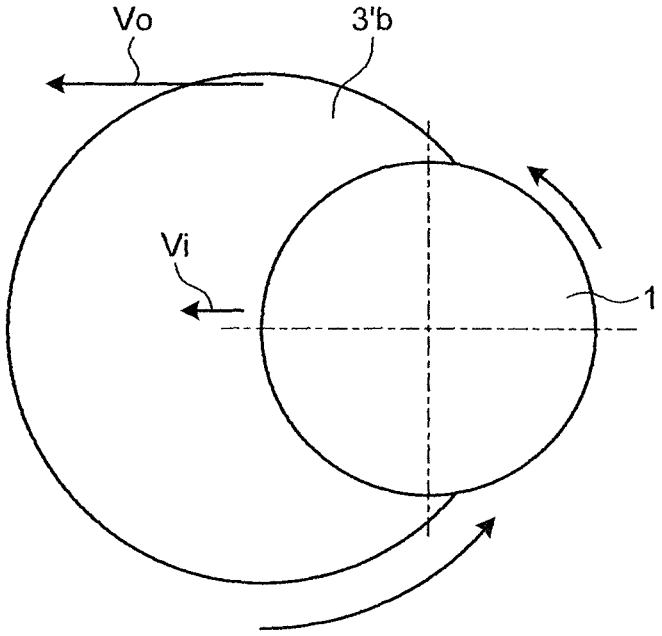
FIG. 7 is a schematic view (top view) describing the polishing by the conventional polishing tool.

Next, polishing for the lens 1 by the polishing device 100 according to the embodiment will be described. FIGS. 4 and 5 are schematic views (cross-sectional view and top view) each describing the polishing for the lens 1 in the polishing device 100 according to the embodiment. FIGS. 6 and 7 are schematic views (cross-sectional view and top view) each describing polishing by a conventional polishing tool.

In the embodiment, the lens 1 is polished by the polishing device 100 in such a way that the polishing tool 3 is swung at a constant swing width with respect to a swing center position illustrated in FIG. 4 while rotating the polishing tool 3 around a rotation axis O by the rotation motor 7. As illustrated in FIG. 4, the swing center position is provided at a position where a straight line L, which passes through a center C of the lens 1 and intersects with the rotation axis O, passes through a center W of a spherical zone of the polishing surface 3*b* in a width direction. In response to frictional force generated by the rotation of the polishing tool 3, the lens 1 is rotated together with the polishing tool 3 in the same direction as the rotation direction. Although the lens 1 is polished by the polishing surface 3*b* having the spherical zone shape, there is a difference in peripheral velocity between an inner edge side (inner diameter Dn) of the polishing surface 3*b* and an outer edge side (outer diameter Dg) of the polishing surface 3*b*. The applicant has found that when a peripheral velocity ratio is large, surface distortion occurs at the lens processing surface 1*a* of the lens 1, resulting in a reduction in surface accuracy. Such surface distortion includes, for example, "middle high" and "middle low", i.e. a central part of a lens is higher or lower than that of a reference lens serving as a standard.

As illustrated in FIGS. 6 and 7, a conventional polishing tool 3' polishes the lens 1 using an entire polishing surface 3'*b* extending from a center to an outer edge. In this case, peripheral velocity Vi near the center is significantly smaller than peripheral velocity Vo in the vicinity of the outer edge, and a peripheral velocity ratio Vo/Vi (i.e. Dg/Dn, which indicates a ratio of the outer diameter of the polishing surface 3'*b* to the inner diameter of the polishing surface 3'*b*) is significantly large, that is, equal to or greater than 10.

With regard to the polishing tool 3 according to the embodiment, as illustrated in FIGS. 4 and 5, the hole 3*c* is provided inside the polishing surface 3*b*, and the lens 1 is polished by the polishing surface 3*b* having the spherical zone shape. In the embodiment, a peripheral velocity ratio Vo/Vi of peripheral velocity Vo at the outer edge side of the polishing surface to peripheral velocity Vi at the inner edge side of the polishing surface can be smaller than that of the conventional polishing tool. Therefore, generation of the surface distortion can be suppressed, and surface accuracy of the lens processing surface 1*a* can be improved. In the embodiment, the peripheral velocity ratio Vo/Vi is equal to or less than 6.0, preferably equal to or less than 4.0, and more preferably equal to or less than 3.0. The closer to 1.0 the peripheral velocity ratio Vo/Vi is, the more suppressed the surface distortion can be. When the peripheral velocity ratio Vo/Vi becomes closer to 1.0, however, the polishing tool 3 becomes larger, whereby workability is deteriorated, and a cost of the polishing tool 3 is increased. The peripheral velocity ratio Vo/Vi is, therefore, preferably equal to or greater than 2.0.

In the polishing tool 3 according to the embodiment, a ratio $\alpha R/\alpha L$ of a spherical zone width of the polishing surface 3*b* to an outer diameter of the workpiece, namely the lens 1 (refer to FIG. 4, hereinafter referred to as a "ring width coefficient") is preferably equal to or greater than 0.9. When the ring width coefficient is equal to or greater than 0.9, the surface accuracy of the lens processing surface 1*a* can be further improved. The ring width coefficient may exceed 1.0 as long as it is equal to or greater than 0.9. When the ring width coefficient becomes too large, however, the polishing tool 3 becomes larger, whereby the workability is deteriorated, and the cost of the polishing tool 3 is increased. The ring width coefficient is, therefore, preferably equal to or less than 1.1.

In the polishing tool according to the embodiment, since the hole is provided so as to have the opening at the top of the polishing surface, a ratio of the outer diameter' to the inner diameter is small. Thus, in the polishing tool according to the embodiment, the workpiece is polished by the polishing surface having the spherical zone shape and having the small peripheral velocity ratio. As a result, the generation of the surface distortion can be suppressed, and the surface accuracy can be improved.

Figure 8A:
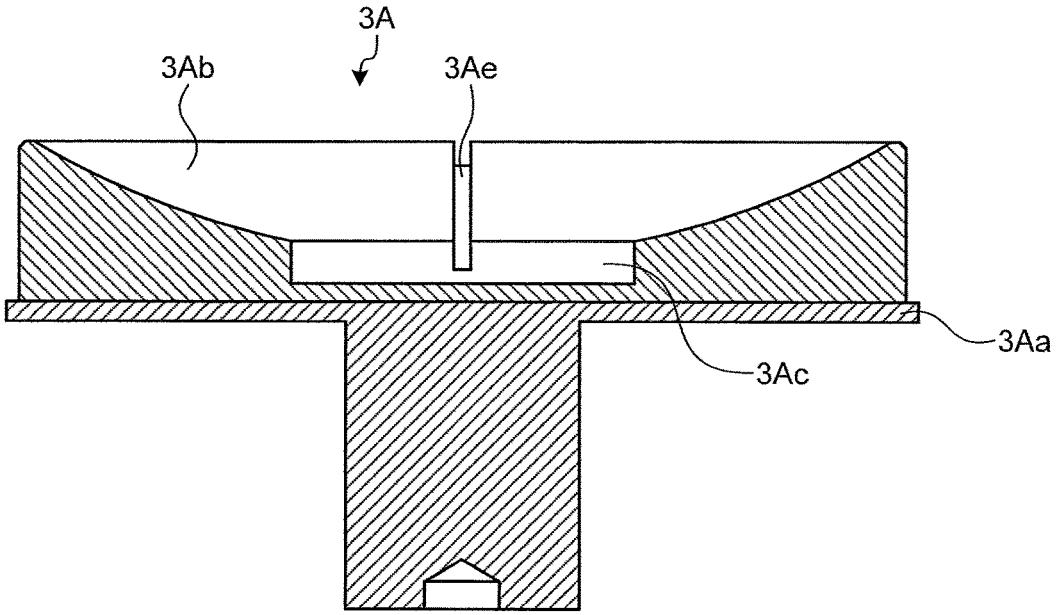
FIG. 8A is a cross-sectional view illustrating a polishing tool according to a first modification of the embodiment of the present invention.

The viscoelastic sheet made of, for example, the polyurethane is stuck to the polishing tool used in the above-mentioned embodiment. Alternatively, abrasive grains for polishing can be fixed with resin or the like on the base plate, which is to be cut to form the polishing surface. A polishing tool with such a polishing surface can also be used. FIG. 8A is a cross-sectional view illustrating a polishing tool 3A according to a first modification of the embodiment. In order to form the polishing tool 3A, abrasive grains for polishing are fixed with resin or the like on a base plate 3Aa to form an abrasive grain body in a cylindrical shape. The abrasive grain body is then cut to form a polishing surface 3Ab having a predetermined radius of curvature, a hole 3Ac, and a groove 3Ae. In the present modification, a ratio of an outer diameter of the polishing surface 3Ab of the polishing tool 3A to an inner diameter of the polishing surface 3Ab of the polishing tool 3A is equal to or less than 6.0, whereby the surface accuracy of the workpiece can be improved in the same way as the embodiment.

Figure 8B:
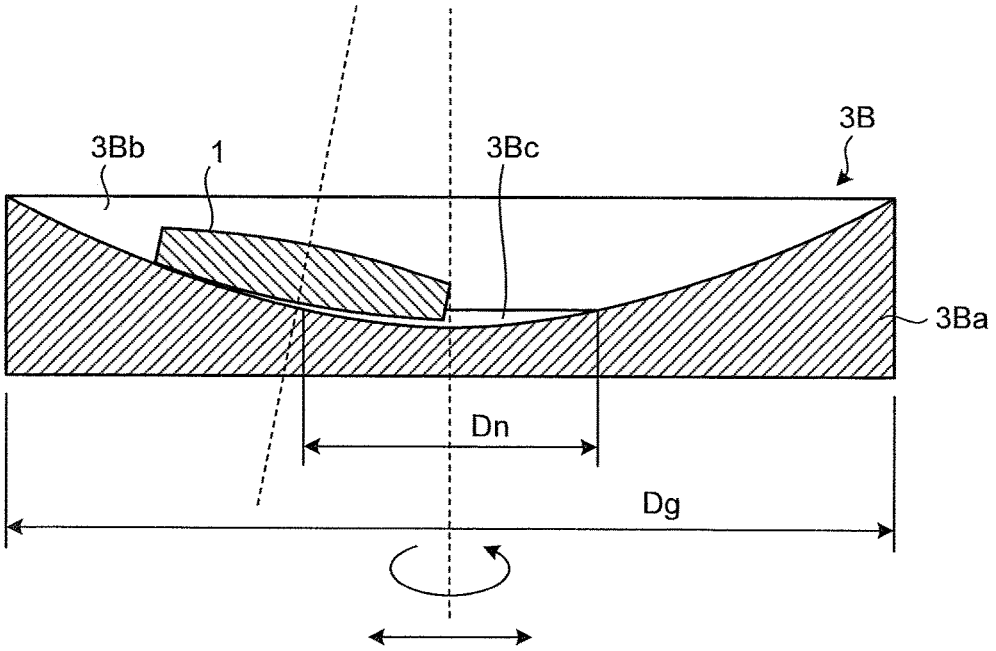
FIG. 8B is a schematic view (cross-sectional view) describing polishing for a lens in a polishing tool according to a second modification of the embodiment of the present invention.

The hole of the polishing tool according to the embodiment of the present invention may be formed to have a gentle concave shape so as not to come into contact with the lens during polishing. FIG. 8B is a schematic view (cross-sectional view) describing polishing for the lens 1 in a polishing tool 3B according to a second modification of the embodiment. The polishing tool 3B has a concave part 3Bc inside a polishing surface 3Bb of a base plate 3Ba. In the same way as the base plate 3*a* of the embodiment, the base plate 3Ba is formed to have a predetermined radius of curvature obtained by substantially inverting a shape of the workpiece, namely the lens 1. A viscoelastic sheet made of, for example, polyurethane is stuck to a surface of the base plate 3Ba, whereby the polishing surface 3Bb having the predetermined radius of curvature is formed. The concave part 3Bc is provided inside the polishing surface 3Bb and is concentric with an outer edge of the polishing surface 3Bb. When the lens 1 is polished by the polishing tool 3B, the lens 1 does not come into contact with the concave part 3Bc as illustrated in FIG. 8B. In the second modification of the embodiment, the concave part 3Bc is provided inside the polishing surface 3Bb, whereby a peripheral velocity ratio Vo/Vi of peripheral velocity Vo at an outer edge side (outer diameter Dg) of the polishing surface to peripheral velocity Vi at an inner edge side (inner diameter Dn) of the polishing surface can be smaller than that of the conventional polishing tool, in the same way as the embodiment. Therefore, the generation of the surface distortion can be suppressed, and the surface accuracy of the lens processing surface 1*a* can be improved.

The above-mentioned embodiment is merely an example for performing the present invention, and the present invention is not limited to this embodiment. In the present invention, a plurality of components disclosed in the embodiment can be appropriately combined so as to form various inventions. The present invention can be variously modified according to a specification or the like, and can further include various other embodiments within a scope of the present invention.

EXAMPLES

A lens was polished by a polishing tool while changing a peripheral velocity ratio Vo/Vi (peripheral velocity ratio of peripheral velocity Vo at an outer edge side of a polishing surface to peripheral velocity Vi at an inner edge side of the polishing surface; 5.0, 2.7, 2.5, and 10.8) and a ring width coefficient $\alpha R/\alpha L$ (a ratio of a spherical zone width of the polishing surface to an outer diameter of the lens; 0.7, 1.0, and 0.65). Surface accuracy of a lens processing surface after the polishing was then evaluated. The peripheral velocity ratio Vo/Vi is equal to a ratio Dg/Dn of an outer diameter of a polishing surface 3*b* to an inner diameter of the polishing surface 3*b*.

Example 1

The lens was polished by the polishing tool when the peripheral velocity ratio Vo/Vi was set to 5.0 and the ring width coefficient αR/αL was set to 0.7. At the time of the polishing, the number of rotations of the polishing tool was 800 rpm, a swing angle was 11.0±2.0°, a curvature of the lens was 64 mm, and a diameter of the lens was 21 mm.

Example 2

The lens was polished by the polishing tool when the peripheral velocity ratio Vo/Vi was set to 2.7 and the ring width coefficient αR/αL was set to 0.7. At the time of the polishing, the number of rotations of the polishing tool was 800 rpm, the swing angle was 14.2±2.0°, the curvature of the lens was 64 mm, and the diameter of the lens was 21 mm.

Example 3

The lens was polished by the polishing tool when the peripheral velocity ratio Vo/Vi was set to 2.5 and the ring width coefficient αR/αL was set to 1.0. At the time of the polishing, the number of rotations of the polishing tool was 800 rpm, the swing angle was 21.3±2.0°, the curvature of the lens was 64 mm, and the diameter of the lens was 21 mm.

Comparative Example

The lens was polished by the polishing tool when the peripheral velocity ratio Vo/Vi was set to 10.8 and the ring width coefficient αR/αL was set to 0.65. At the time of the polishing, the number of rotations of the polishing tool was 800 rpm, the swing angle was 7.5±2.0°, the curvature of the lens was 64 mm, and the diameter of the lens was 21 mm.

FIGS. 9 to 12 are diagrams each illustrating a difference value in an X direction and a Y direction of the lens between a height of a lens surface polished by the polishing tool according to each of Examples 1 to 3 and Comparative Example and a height of a standard spherical surface of a reference lens.

Figure 9:
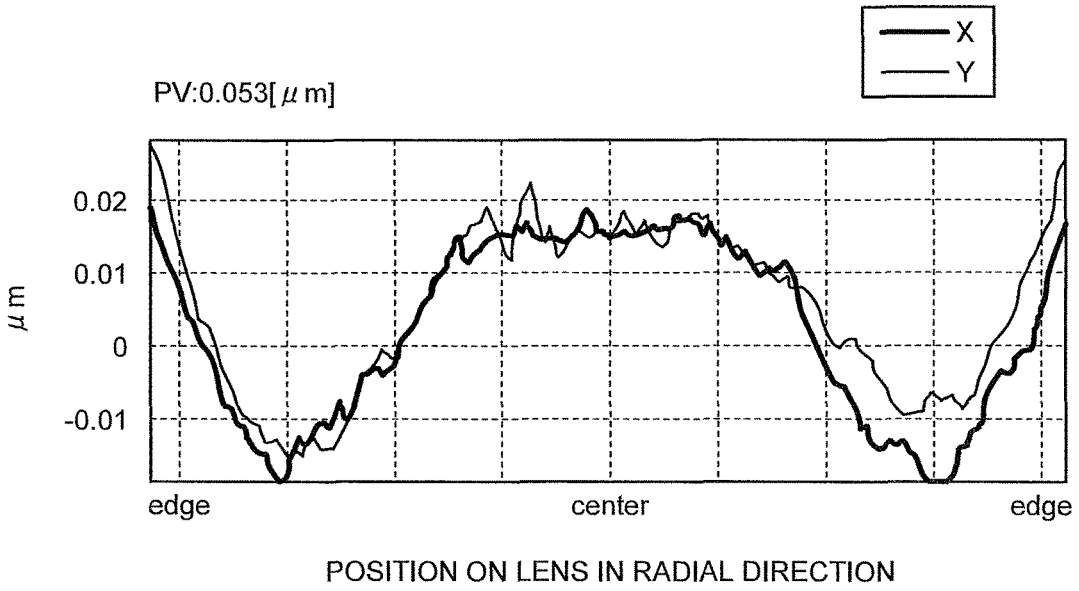
FIG. 9 is a diagram illustrating a difference between a lens surface polished by a polishing tool of Example 1 and a standard spherical surface of a reference lens.
Figure 10:
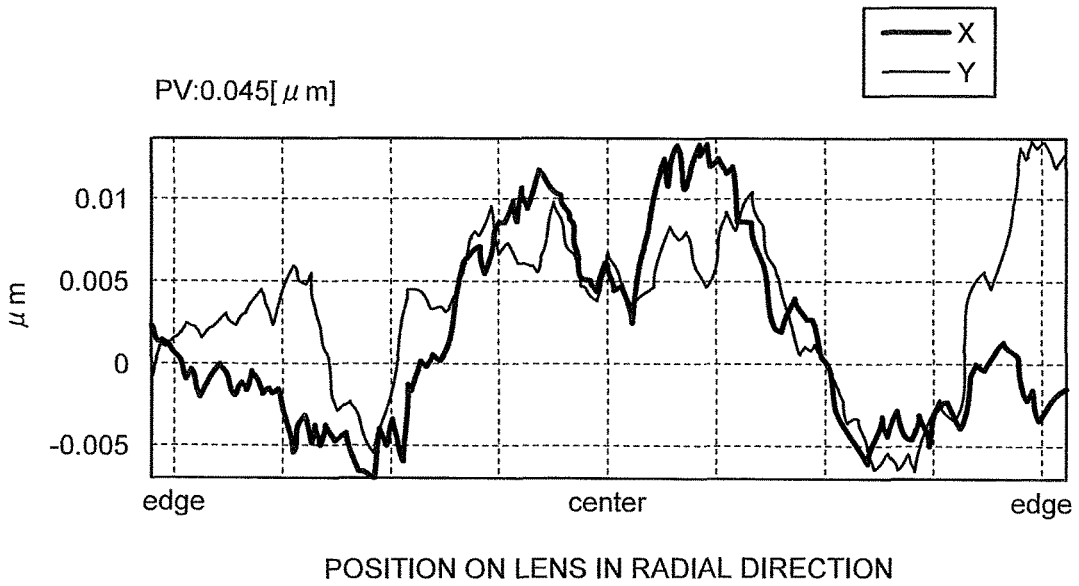
FIG. 10 is a diagram illustrating a difference between a lens surface polished by a polishing tool of Example 2 and the standard spherical surface of the reference lens.
Figure 11:
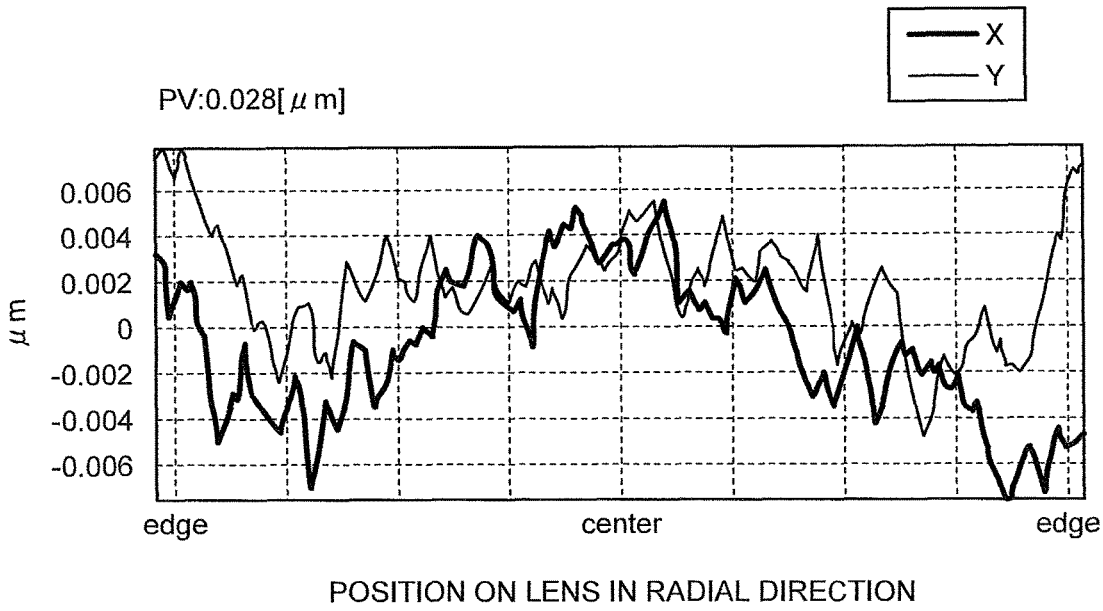
FIG. 11 is a diagram illustrating a difference between a lens surface polished by a polishing tool of Example 3 and the standard spherical surface of the reference lens.
Figure 12:
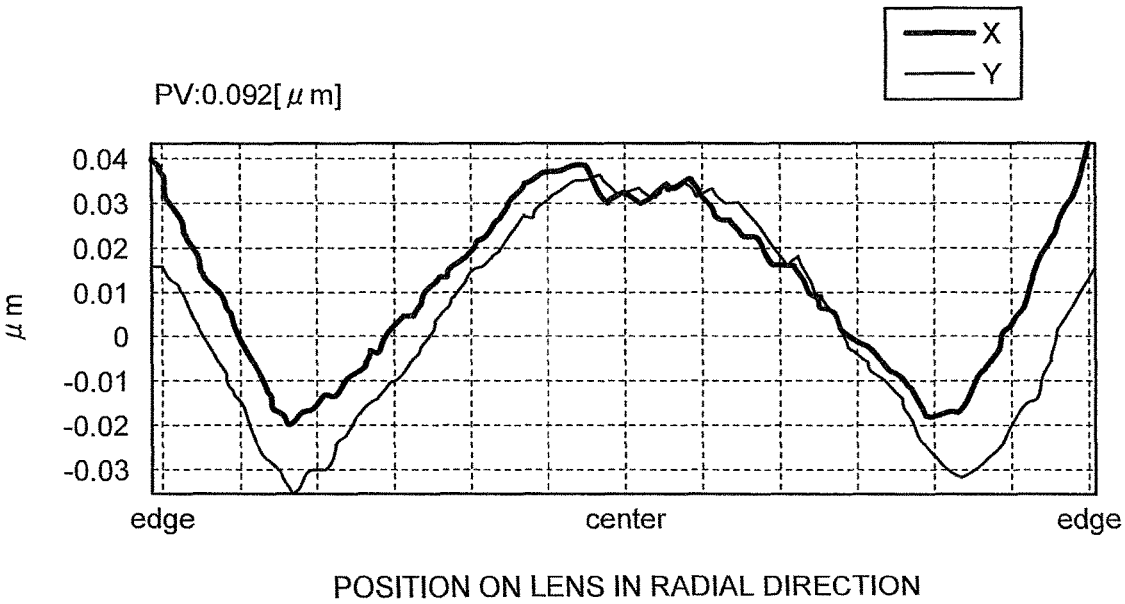
FIG. 12 is a diagram illustrating a difference between a lens surface polished by the conventional polishing tool (Comparative Example) and the standard spherical surface of the reference lens.

The conventionally-used polishing tool in the Comparative Example has the peripheral velocity ratio Vo/Vi of 10.8. When the lens having the ring width coefficient αR/αL of 0.65 is polished by such a polishing tool, "middle high" surface distortion, which means that a central part of the lens is high, occurs as illustrated in FIG. 12. On the other hand, it has been found that the surface distortion can be reduced as illustrated in FIGS. 9 to 11 when the peripheral velocity ratio Vo/Vi is equal to or less than 6.0 as represented in Examples 1 to 3. More specifically, it has been found that the surface distortion is further reduced and the surface accuracy is improved in Example 3 where the ring width coefficient αR/αL is equal to or greater than 0.9.

According to some embodiments, it is possible to improve surface accuracy of a workpiece while utilizing an existing device without introducing a new control device or the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for polishing a workpiece executed by a polishing device having a polishing tool, the method comprising the steps of:

arranging the polishing tool on a lower shaft side of the polishing device, the polishing tool including: a polishing surface having a predetermined radius of curvature; and a hole that is provided inside the polishing surface and is concentric with an outer edge of the polishing surface around a rotation axis on a projection plane orthogonal to the rotation axis, wherein the polishing surface has a spherical zone shape, and a ratio of an outer diameter of the polishing surface to an inner diameter of the polishing surface is greater than 1.0 and equal to or less than 6.0, and a ratio of a spherical zone width of the polishing surface to an outer diameter of the workpiece is equal to or greater than 0.9;

arranging only the workpiece on an upper shaft side of the polishing device; and swinging the polishing tool at a constant swing width with respect to a reference point while rotating the polishing tool around the rotation axis to polish the workpiece, wherein the reference point is provided at a position where a straight line, which passes through a center of the workpiece and intersects with the rotation axis, passes through a center of a spherical zone of the polishing surface in a width direction.

* * * * *